United States Patent [19]

Nienow et al.

[11] 3,960,325

[45] June 1, 1976

[54] PORTABLE HEATING AND SPRAYING APPARATUS AND METHOD FOR APPLYING HIGHLY VISCOUS COATING MATERIAL

[75] Inventors: James O. Nienow, West Covina; Deryl S. Yundt, La Canada, both of Calif.

[73] Assignee: Roofmaster Inc., Monterey Park, Calif.

[22] Filed: Mar. 24, 1975

[21] Appl. No.: 561,090

[52] U.S. Cl. ..... 239/13; 239/139; 165/81; 165/104 R; 165/181

[51] Int. Cl.[2] ..... B05B 1/24; F28F 7/00; F28F 1/10

[58] Field of Search ..... 239/128, 135, 139, 130, 239/1, 13; 165/184, 181, 81, 132, 104

[56] References Cited

UNITED STATES PATENTS

| | | | |
|---|---|---|---|
| 1,943,456 | 1/1934 | Potter | 165/81 X |
| 2,199,454 | 5/1940 | Andler et al. | 239/125 X |
| 2,565,543 | 8/1951 | Arvintz et al. | 239/128 UX |
| 2,737,370 | 3/1956 | Frisch et al. | 165/181 UX |
| 2,754,228 | 7/1956 | Bede | 239/139 X |
| 2,762,652 | 9/1956 | Carter | 165/140 X |
| 2,762,901 | 9/1956 | Liedberg | 239/135 X |
| 2,976,392 | 3/1961 | Wabnitz | 239/128 X |
| 3,215,192 | 11/1965 | Sollich | 165/65 X |
| 3,602,296 | 8/1971 | Heyn et al. | 165/81 X |
| 3,880,228 | 4/1975 | Houk et al. | 239/135 X |

FOREIGN PATENTS OR APPLICATIONS

| | | | |
|---|---|---|---|
| 514,295 | 7/1955 | Canada | 239/135 |
| 340,765 | 1/1931 | United Kingdom | 165/181 |
| 3,276 | 1915 | United Kingdom | 239/130 |
| 267,190 | 3/1927 | United Kingdom | 165/181 |
| 700,595 | 12/1953 | United Kingdom | 239/139 |
| 870,718 | 6/1961 | United Kingdom | 239/128 |

*Primary Examiner*—Robert S. Ward, Jr.
*Attorney, Agent, or Firm*—Jackson & Jones

[57] ABSTRACT

The present invention is directed to a method and heating and spraying apparatus utilized for regulating the temperature of highly viscous cold process coating material tht is sprayed by a single pump on a surface, such as a roof and the like. The heating apparatus includes a vat designed to hold a quantity of a heat transfer medium, such as oil. A burner provides a source of heat to the bottom, sides and ends of the tank or vat holding the heat transfer oil. Mounted within the vat is a serpentine configuration of serrated finned tubing. The serrated finned tubing provides the maximum heat transfer while maintaining a compact and portable size. The loops of the serrated finned coils are mounted unconstrained within the vat to permit any relative movement, such as that produced by thermal or pressure expansions. A thermostatically controlled fuel supply system automatically monitors the temperature of the oil transfer bath to regulate the temperature of the coating material. Auxiliary serrated finned coils can be attached to the oil transfer bath and placed in a reservoir of cold process material, for preheating the coating material to facilitate its pumping through the primary serrated finned coil submerged in the heat transfer oil.

23 Claims, 5 Drawing Figures

PORTABLE HEATING AND SPRAYING APPARATUS AND METHOD FOR APPLYING HIGHLY VISCOUS COATING MATERIAL

BACKGROUND OF THE INVENTION

1. Field of the Invention

The present invention is directed to a heating and spraying system for highly viscous liquid and more particularly to the heating and spraying of cold process roof material to an optimum temperature for dispensing irregardless of the ambient temperature.

2. Brief Description of the Prior Art

Tar pitch and asphalt have been heated or liquified for application to roofs for a long period of time in the roofing industry. A kettle or vat holding the asphalt has been heated by a burner fired heater tube system positioned on the bottom of the vat. This design permits the bituminous material to cover and surround the heating tube system. Generally, the tar or asphalt would be placed in a solid state on top of the heating tubes and the passing of hot gases through the tubes would liquify the material for ultimate spreading on a roof.

The Chausse U.S. Pat. No. 2,506,412 represents an improvement on the basic kettle design for the purpose of both transporting and dispensing tar and asphaltic oils under low ambient temperature conditions. In this reagrd, a regard, of tanks are provided adjacent a central heat transfer vat. Compressed air tanks are also provided for ejecting the material from the storage tanks. A closed hot oil transfer system is utilized wherein hot transfer oil is heated in a coil and then piped to the central heat transfer tank for heating the asphalt material.

The Miller U.S. Pat. No. 2,690,172 and U.S. Pat. No. 2,729,209 both disclose apparatus for transporting and heating asphalt. The asphalt tanks are designed to permit a heating liquid to pass through pipes mounted within storage tanks.

The Loebel U.S. Pat. Nos. 3,111,935 and 3,196,841 disclose heaters for asphalt wherein a hot gas helical flue pipe is utilized to heat the asphalt while an outer bath of heat transfer oil is circulated to control the heat exchange.

Finally, the Hynes et al U.S. Pat. No. 3,281,573 discloses a heating system for asphalt equipment, wherein electric coils are utilized to selectively store, or withdraw, heat from the asphalt.

Recently, cold processing roofing material has been developed to replace the asphalt and tar commonly utilized as roofing material. An example of such material is the GAF Corporation MINERAL SHIELD MASTIC, this material purportedly provides a great advantage over the tar pitch and asphaltic oils, utilized previously, in that less man power is required to apply the material and less equipment is needed, since it eliminates hot carriers, gravel handling equipment and kettles. The cold processing material has been described as a filled asphalt or coal tar with solvents having material such as asbestos added to it.

An additional advantage of cold processing material is that pollution is reduced, since the fumes and smoke that are associated with an asphaltic oil or bituminous material is greatly reduced. In addition, it is asserted that the potential for blistering problems when applied to the roof and the criticality of the application of the material is greatly lessened. This cold processing roofing material, however, is relatively temperature sensitive and a cold ambient temperature will greatly increase the viscosity of the material to the point where its application will be prohibited in the Winter months in cold climates. Frequently, it is recommended that the cold processing material be cut with a solvent to increase its flowability and lessen its viscosity. This, however, raises further problems, such as the criticality of the mixing of proportions of the appropriate solvent and the necessity to permit the solvent to evaporate before sheets of the roofing material can be applied or else gas pockets will form under the sheets. Cold processing roofing material that has been cut with too much solvent will flow too easily and produce a resulting thin applied layer of material.

In addition, the spraying equipment which is recommended to be utilized with cold processing material, such as the Mineral Shield Mastic, must be either an internal or external mix system for combining the material with air to atomize the material. As noted by the manufacturer of the above material, airless equipment is not recommended for the distribution of Mineral Shield Mastic, due to its long fiber content and its consistency. It should be realized that when roofing contractors are spraying cold process material, they are frequently dealing with the pumping of the material over a relatively large distance e.g., 200 to 500 feet with a relatively large vertical elevation.

In the field of airless spraying apparatus the following patents are cited of general interest: Glaros — U.S. Pat. No. 3,469,788, Kocher — U.S. Pat. No. 2,631,891 and U.S. Pat. No. 3,197,144, Wagner — U.S. Pat. No. 3,515,355 and Christian — U.S. Pat. No. 2,923,480. The use of airless equipment for material having the viscosity of cold processing material would generally require an extremely high pressure system to atomize the material at the spray nozzle.

As a result of the low viscosity of the heated cold process material, any air or hydraulically operated pump may be used in the spraying operation. The present invention provides a system of changing the viscosity of highly viscous liquids or semi solids such as coal tars, asphalts, bituminous paints, urethanes, polymeric material, etc. and more particularly cold processing roofing material.

With respect to the cold processing roofing material that was formerly applied by changing the viscosity of the material through the dangerous process of thinning with solvents or the possible over heating or scorching of the material with a direct flame to the barrel or heating in direct flame asphalt kettles, the present invention provides a significant improvement in the conventional application of the material. This is accomplished by a controlled heating of the cold process roofing material in a highly efficient manner to facilitate spraying.

SUMMARY OF THE INVENTION

The present invention provides a method and apparatus for heating and spraying a highly viscous material such as cold processing roofing material. A tank is utilized to hold a fluidic heat transfer medium such as oil to permit a constant even application of heat. The tank is directly heated by a burner. A serrated finned heat transfer coil is freely mounted within the tank and is connected to a pump for supplying the cold processing roofing material. A spray gun is connected directly to the other end of the heat transfer coil for distributing the cold processing roofing material to a surface to be coated without the assistance of compressed air or a booster pump. The spray pattern of the cold processing roofing material is both consistent and sharply defined. Automatic control means are provided for monitoring the temperature of the heat transfer medium and correspondingly controlling the burner that supplies heat to the tank.

The present invention provides a method for spraying a cold processing roofing material that previously required booster pumps and compressed air. Pressure can be applied to the cold processing roofing material from a single pump with an in line heating of the material as it passes directly to a spraying apparatus.

The present invention both to its organization and manner of operation, together with further objects and advantages thereof, may best be understood by reference to the following description, taken in connection with the accompanying drawings and claims.

BRIEF DESCRIPTION OF THE DRAWINGS

FIG. 5 is a perspective view of a portion of the heating coil of the present invention.

BRIEF DESCRIPTION OF THE PREFERRED EMBODIMENT

The following specification taken in conjunction with the drawings sets forth the present invention in such a manner that any person skilled in the art, can make and use the invention. The embodiment of the invention disclosed herein, is the best mode contemplated by the inventor in carrying out his invention in the commercial environment, although it should be understood that various modifications can be accomplished within the parameters of the invention.

The present invention for preheating cold processing roofing material, has been specifically designed to extend the spraying season for all cold processing roofing material irregardless of the ambient temperature. The workman has an advantage of a constant sharply defined spray pattern at a relatively low pressure by the preheating of the cold processing roofing material with the heating and spraying apparatus of the present invention. There is no necessity to atomize the cold processing roofing material and thus the spray pattern is considerably improved and there is no resulting "fog" from an air system. In addition, only one pump is necessary for both heating and spraying and a considerably savings in money can thereby be realized.

Figure 1:
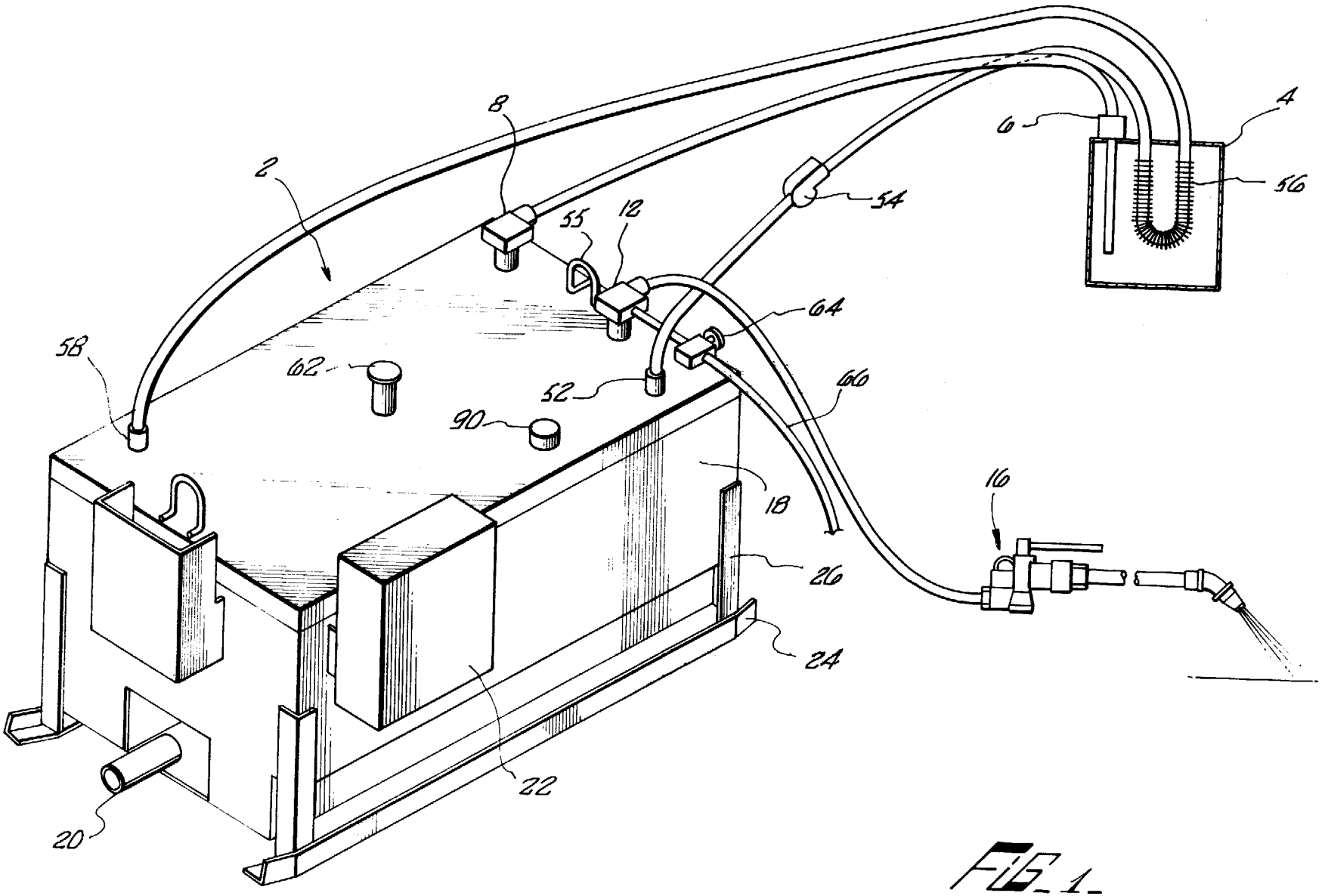
FIG. 1 is a perspective view of the heating and spraying apparatus of the present invention.

Referring to FIG. 1, a perspective view of the present invention is disclosed. The kettle 2 of the present invention, is appropriately connected through a single pump 6 to a container or reservoir 4 of the cold processing roofing material. The pump 6 is selected to provide a sufficient pressure differential to the cold processing roofing material to move it from the reservoir 4 to the kettle 2 and also spray the material. Generally, the roofing material will be provided in barrels as schematically shown in FIG. 1.

Figures 2, 6:
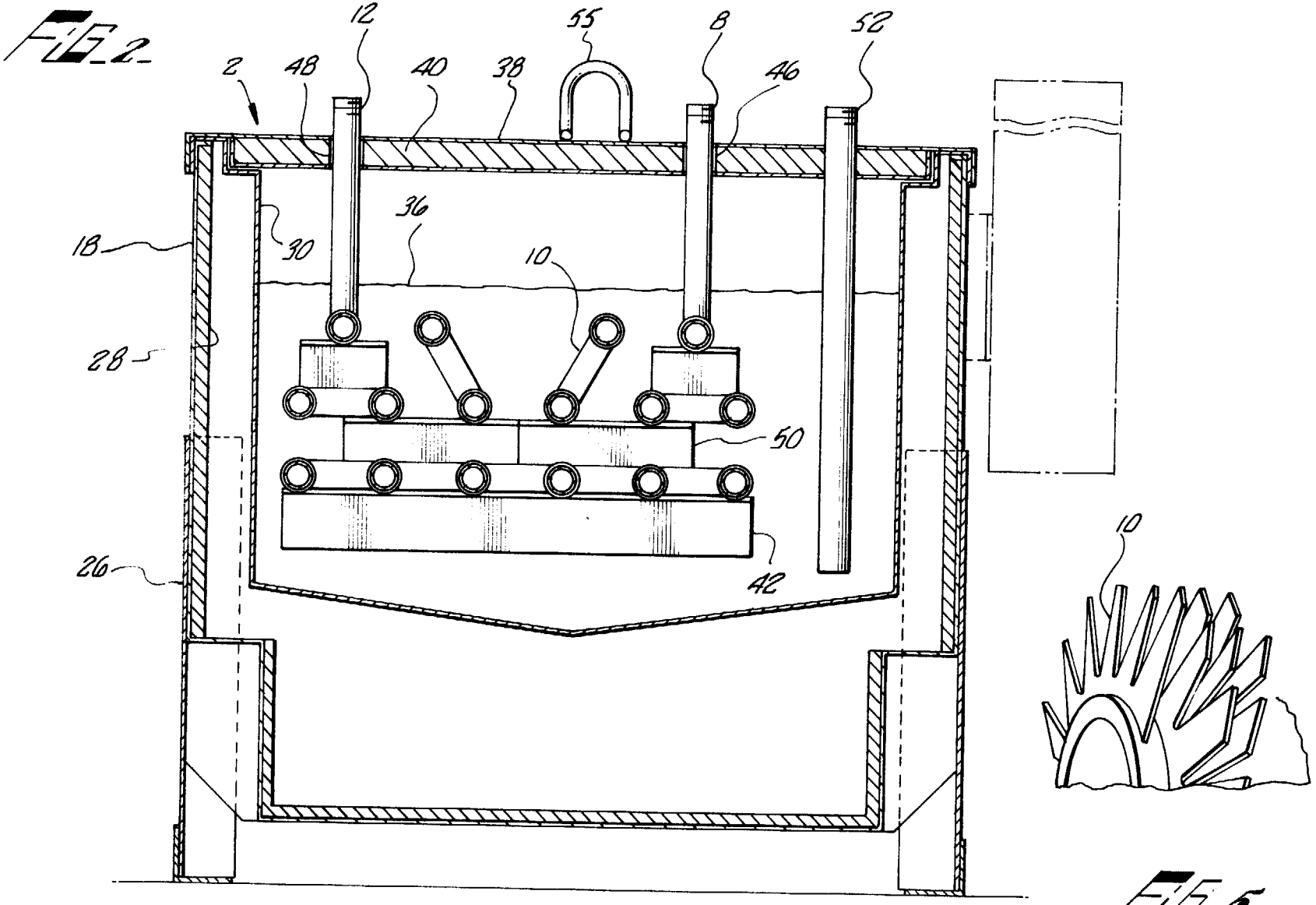
FIG. 2 is a cross sectional view of the kettle of FIG. 1.

Referring to FIG. 2 and FIG. 5, an intake conduit 8 is attached to a serpentine configuration of serrated finned heating coils 10. An example of an applicable serrated finned heat exchanger can be found in the Boose U.S. Pat. No. 3,752,228. The serrated finned heating coil 10 comprises a number of lengths of individual heating coils that are attached together for example, by welding with 180° welding bends to form a serpentine configuration of vertically arranged and spaced loops. The use of this serrated finned heating coil 10 provides a distinct improvement over a plain tube heat exchanger, since the heat exchanger, surface area is increased approximately six fold as great as the area of the plain tube. This provides the distinct advantage of being able to manufacture a compact heater assembly as compared to the prior art heaters. The serrated finned heating coil 10 is hydraulically tested to insure a safe operation.

The serrated finned heating coil 10 is attached at one end to the pump 6 through the intake conduit 8 and at the other end to an exhaust conduit 12 which in turn is attached to a sprayer 16. The pump 6 is designed to provide sufficient hydraulic pressure to the cold processing roofing material to permit both heating and application by dispensing or spray apparatus, such as a heavy duty pole gun 16.

Figure 3:
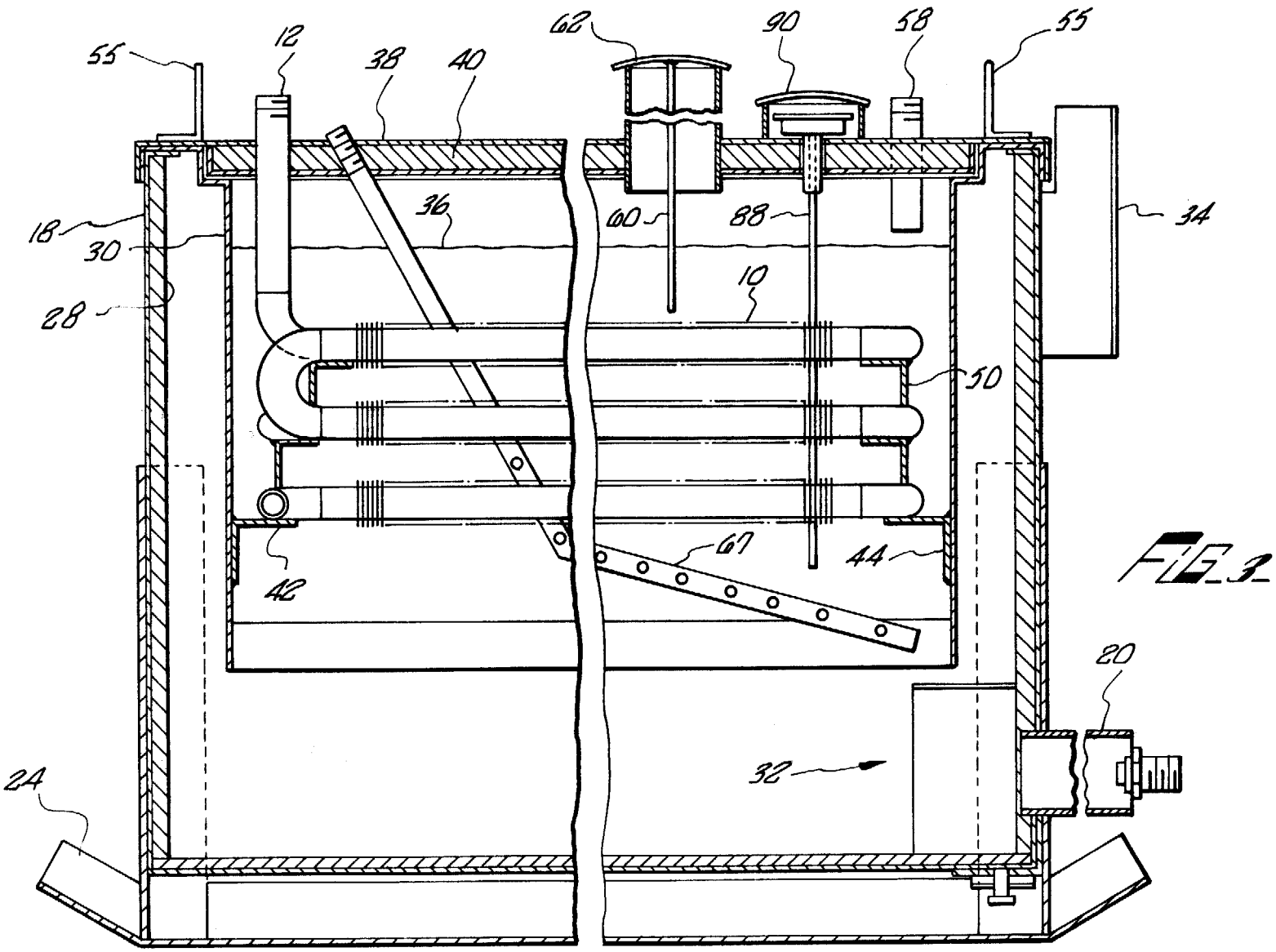
FIG. 3 is a longitudinal cross sectional view of the kettle of FIG. 1.

Referring more specifically to FIGS. 2 and 3, the kettle 2 includes an outer housing 18 of heavy duty sheet metal having roughly a rectangular configuration. A burner 20, controlled by an automatic control box 22, is mounted on the kettle 2 to provide a source of heat. Generally, the burner 20 will be fired by a liquidified petroleum gas.

Supporting rails or skids 24 are mounted on the outer housing 18 by angle iron posts 26. The skids 24 can be of angle iron stock with appropriate holes for mounting on a trailer or truck bed. Asbestos insulating liners 28 are mounted on the inside of the outer housing 18. A welded tank 30 is suspended from the top walls of the outer housing 18 and forms the upper half of a combustion chamber 32 which is fired by the burner 20. The asbestos insulating sheets 28 keep the exterior of the outer housing 18 cool enough to permit handling by workmen. A flue or exhaust shield 34 is mounted above the burner 20 on the outer housing 18 for exhausting the combustion products.

The tank 30 has a sloping bottom and the hot air current from the burner 20 extends not only along the bottom of the tank 30, but also upward along each of the side walls between the tank 30 and the asbestos sheets 28 on the outer housing 18. A sandwich construction lid 38 having an intermediate fiber glass lining 40 is utilized to close tank 30 with appropriate fasteners.

A liquid heat transfer medium 36 such as Chevron heat transfer oil No. 1, is positioned in the tank 30. Generally, any heat transfer oil can be utilized as the heat transfer medium although a paraffinic base oil having appropriate additives, to inhibit oxidation and clean the heat transfer surfaces is preferred.

The serrated finned heating coil 10 is freely mounted in the tank 30. This is accomplished by resting the coil 10 on mounting brackets 42 and 44 which are respectively welded on either end of the tank 30. The mounting brackets, 42 and 44, permit the serpentine loops configuration of the serrated finned heating coil 10 to be supported in an unrestrained manner on the mounting brackets. Alignment of the serrated finned heating coil 10 in the tank 30 is maintained by the ports 46 and 48 in the lid or cover 38.

Spacer members 50 are welded to the top of at least a pair of heat exchange coil loops for maintaining a desired set distance and for providing intra-loop support. By welding the spacer members 50 to only the top of the coil loops, the individual loops in the serpentine configuration of the heating coil 10 are thereby permitted relative movement. Thus, any vibration, pressure expansion or thermal expansion of the loops can be easily accommodated within the heating coil configuration. In addition, that portion of the heating coil tube that extends respectively through the cover ports 46 and 48, are likewise unrestrained and permit relative movement between the coils and the tank 30 and housing cover 38.

As an auxiliary feature of the present invention, a coupling member 52 can be provided for attachment to an appropriate pump 54 to circulate hot transfer oil 36 from the tank 30 for other uses such as heating an auxiliary serrated finned heating coil unit 56 that is emerged in a barrel or reservoir 4 of cold processing roofing material. A return coupling member 58 is further provided on the lid 38 for receiving the return flow of heat transfer oil 36 from the barrel 4. Thus, during a low temperature operation, the cold process material in a barrel or reservoir 4 can be heated to make it less viscous and more adaptable for pumping into the primary tank 30. A pair of lifting books 55 can be further provided on the cover lid 58 for transporting the kettle 2.

A dip stick 60 can be mounted within a filler cap 62 on the cover 38 for respectively measuring the depth of the heat transfer oil to be sure that the coils are adequately covered and further to relieve any pressure developed in the tank 30 by oil fumes. A thermometer 88 and cap 90 are also mounted on the cover 38 for monitoring the heat transfer oil temperature.

A manual valve 64 and an over flow line 66 are attached to the exhaust conduit 12. An appropriate receptacle can be placed at the bottom of the over flow line 66 to receive any over flow expanding cold processing material from the coil 10 after pump shut down.

Figure 4:
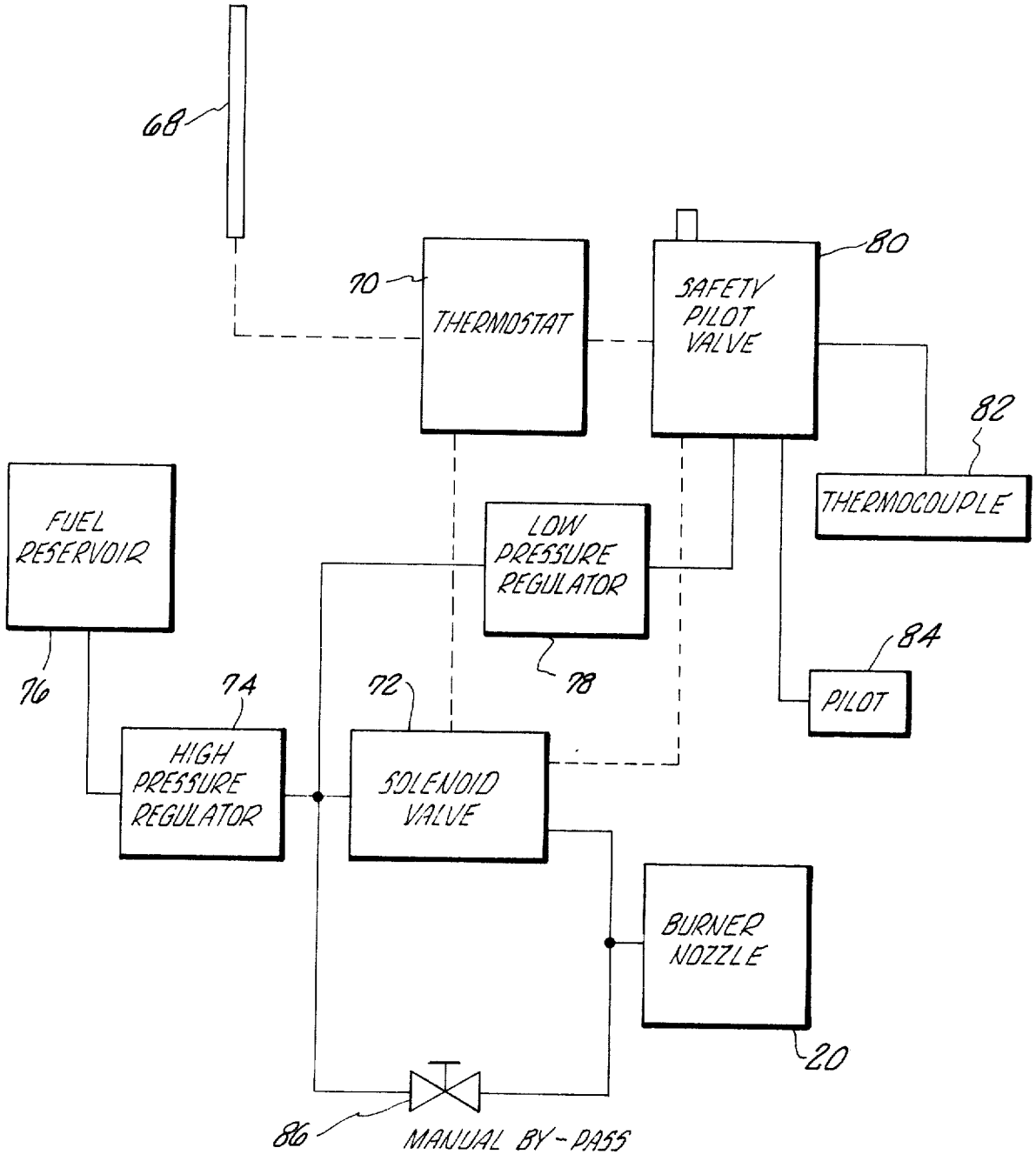
FIG. 4 is a schematic of the automatic temperature control of the present invention.

Referring more specifically to the schematic of FIG. 4, the automatic heat control system of the present invention is disclosed. The actual control components are mounted in the control box 22 shown on FIG. 1. A heat sensor such as a capillary tube 68 is mounted within a capillary tube housing 67 mounted within the tank 30 and extends into the heat transfer oil 36. The heat sensor 68 provides a pressure signal to a thermostatic control unit 70, which can be, for example, a Robertshaw KS-76 thermostat unit having a manually settable temperature dial. The thermostat unit 70 is electrically connected to a solenoid valve 72 which can comprise a General Controls high pressure, self energized gas valve Model No. B61Y12. The solenid valve 72 is diaphragm operated and has a high pressure regulator 74 positioned upstream of the valve 72 in the fuel line downstream of the fuel tank or reservoir 76.

Fluidically connected upstream of the solenoid valve 72, is a low pressure regulator 78 which in turn is connected to a safety pilot valve 80 such as the General Controls Model No. MR-2YA01F safety pilot valve. The safety pilot valve 80 is connected respectively to the thermostat unit 70, the solenoid valve 72 and a thermocouple 82 positioned adjacent a pilot burner 84. The thermocouple 82 determines if the pilot 84 is lit and prevents the firing of the main burner 20 if the pilot 84 is extinguished.

A manual bypass valve 86 permits the automatically controlled solenoid valve 72 to be bypassed, if required due to malfunction of the automatic heat control system. The fuel burner 20 can be either vapor or liquid. If liquid, a heat exchanging coil can be wrapped about or adjacent to the burner to vaporize the liquid fuel upstream of the high pressure regulator 74.

In operation, the automatic heat control system maintains a constant monitoring of the temperature of heat transfer oil 36 via the heat sensor 68. The thermostat 70 has been manually set by an operator to the desired temperature of the heat transfer oil bath in the tank 30 taking into consideration the flow rate of the cold processing material through the coil 10. When a signal from the heat sensor 68 indicates a discrepancy in the actual heat transfer oil 36 temperature and the temperature set on the thermostat 70, then the solenoid valve 72 is appropriately opened or closed to regulate the delivery of the fuel to the burner 20.

The high pressure regulator 74 simply provides a constant pressure source which can be appropriately metered by the solenoid valve 72. The manual bypass valve 86 permits the automatic control to be bypassed in special situations. The safety pilot valve 80, the low pressure regulator 78 and the thermocouple 82 are simply safety features to insure that the burner 20 will only be fired when it can be ignited by the pilot 84. If desired, the flow rate of the cold processing material can be monitored along with the initial entering temperature of the cold processing material. These two readings can be further applied to the thermostat 70 to maintain the spray temperature at an optimum condition.

The heat transfer oil 36 within the tank 30 is preferably checked by an operator with the dip stick 60 prior to the firing of the burner 20 to be sure the coil 10 is covered with oil. The burner 20 is then activated through the controls of the control box 22 whereby the heat transfer heat oil 36 is brought to the desired temperature as monitored by the heat sensor 68.

The roofing material to be sprayed, such as the cold processing roofing material, is introduced within the serrated finned coil 10. As an additional feature of the present invention, an auxiliary heating coil unit 56 can be placed within a barrel of the cold processing roofing material to facilitate the introduction of the material into the tank 30.

Generally, the heat transfer oil bath 36 is maintained at a temperature which will insure that the cold processing roofing material is above 100°F and approximately 130°F as it leaves the kettle 2. Obviously, the temperature of the heat transfer oil 36 may vary to take into consideration the initial entering temperature of the cold processing roofing material and the pumping rate of the various pumps. The operator, besides checking the level of the heat transfer oil 36 will also close the valve 64.

As the cold processing material enters the intake conduit 8 it is progressively heated by the heat passing through the serrated finned tubing 10. The serrated finned tubing 10 has the capability of transmitting five to six times as much heat as conventional plain tubing. Thus, the cold processing material, can be quickly brought and maintained at the desired temperature. Any expansion of the serpentine serrated finned heating coil 10 can be adequately accommodated in the kettle 2 by the unrestrained mounting of the coil configuration.

Previously, with conventional roof spraying apparatus for dispensing cold processing roofing material, an air control package was required for attachment of compressed air to, for example, a heavy duty pole gun. Generally, the air spraying equipment would be of the internal mix system or the external mix system. The internal mix system would require the addition of compressed air to the extruding mastic cold processing material at a point just before leaving the nozzle of the spray gun. The compressed air would supply the necessary force to atomize the mastic material.

The alternative external mix system also used by the prior art, would exude the material beyond the nozzle of the spray gun where it will then be combined with air to produce the atomizing spray. Both systems would require a pump downstream of the spray gun to provide sufficient pressure for spraying purposes. Airless equipment was not recommended for use because of the necessity of an extremely high pressure due to the viscous nature of the cold processing roofing material especially in relatively cold ambient temperatures. With the cold temperatures, the cold processing roofing material would be cut with a solvent to lessen its viscosity and to improve its spraying characteristics. This approach however, would necessitate a dwell time period after the spraying operation to permit the evaporation of the solvent before depositing roofing sheets.

With the spraying system of the present invention, the heated cold processing material can be pumped by a pump 6, directly into the coil 10 and then immediately sprayed to provide an in line heating operation from the source of the cold processing material straight through to the spray gun 16. The cold processing roofing material is heated to an elevated temperature of above 100°F., e.g. 130°F, and can be directly sprayed without the use of compressed air or an airless booster pump. Since air is not necessary, the spray pattern is sharply defined and facilitates the application of the roofing material. With the present invention, the ambient temperature is not a factor in the spraying operation. Thus, the present invention provides both apparatus and teaches a method of applying cold processing material which actually runs directly counter to the specific intent in the development of cold processing material, that is, application at ambient temperatures and the recommended methods of applying cold processing roofing material. As a result of the present invention, the ability of a workman to apply a high quality application of cold processing roofing material is greatly increased.

The use of the heat transfer oil bath for regulating the application of heat to the cold processing material through the serpentine serrated finned tube coil 10 insures that the cold processing material is maintained at a temperature below its flash point and thus safely handled. Since the heat transfer oil can supply a constant gradient of heat, the dangers of a hot point in the system are eliminated and the equipment can be safely operated by an average workman.

As can be readily appreciated, it is possible to deviate from the above embodiments of the present invention and will be readily understood by those skilled in the art that the invention is capable of many modifications and improvements within the scope and spirit thereof. Accordingly, it will be understood that the invention is not to be limited by the specific disclosed embodiment but only the scope and spirit of the appended claims.

What is claimed is:

1. A spraying system for spraying cold processing roofing material from a reservoir comprising:

a tank adapted to hold a fluidic heat transfer medium;

means for supplying heat to the tank to heat the heat transfer medium;

a serrated finned heat transfer coil mounted within the tank including a plurality of loop sets of tubing, at least a pair of tubing sets positioned apart by at least one spacer member, the spacer member attached to only one of the set of loops to permit relative movement between the pair of tubing sets;

a pump connected to the reservoir and to one end of the serrated finned heat transfer coil; and spraying means connected to the other end of the heat transfer coil for distributing the cold processing roofing material to a surface to be coated, the fluidic heat transfer medium substantially surrounding the serrated finned heat transfer coil to effectuate a controlled, even heat transfer to the cold processing roofing material as it is pumped from the reservoir through the serrated finned heat transfer coil to the spraying means.

2. The invention of claim 1 further including automatic control means for controlling the temperature of the heat transfer medium in the tank.

3. The invention of claim 1 further including an auxiliary heating coil adapted to be placed in the reservoir of cold processing roofing material and auxiliary pump means, wherein the auxiliary pump means can be attached to the tank and the auxiliary heating coil to pump the heat transfer medium to and from the auxiliary heating coil for preheating the cold processing roofing material to facilitate the pumping of the cold processing material to the heat transfer coil.

4. The invention of claim 1 further including an outer housing having walls, the tank suspended only from the upper walls of the outer housing within the outer housing.

5. The invention of claim 2 wherein the means for supplying heat includes a burner and source of fuel and the automatic control means includes, a heat sensor, a thermostat, a solenoid valve and a pressure regulator, the pressure regulator connected to the source of fuel and solenoid valve and maintaining a constant pressure of fuel upstream of the valve which in turn is connected to the burner, the heat sensor is connected to the thermostat and positioned in the heat transfer medium, the thermostat is connected to the solenoid valve for controlling the flow of fuel to the burner in response to a signal from the heat sensor.

6. The invention of claim 5 further including a safety pilot control means for preventing the flow of fuel to the burner if the burner is not lit.

7. An airless spraying method of applying a viscous cold processing roofing material such as a filled liquid bituminous based cut back material onto a surface such as a roof, at cold ambient temperatures, with a single pump, a tank and a finned heat exchange coil surrounded by a heat transfer medium such as oil, in the tank comprising the steps of:

supplying heat directly to the outside surface of the tank to heat the heat transfer medium to a predetermined temperature;

applying a pressure differential to the cold processing roofing material to pump both liquids and suspended solids directly from a source into the heat exchange coil;

heating the cold processing roofing material as it passes through the heat exchange coil to a temperature within the approximate range of 100°F to 130°F; and spraying the cold processing roofing material liquids and suspended solids with only a pressure head created by the same pressure differential that pumped the cold processing roofing material through its heat exchange coil.

8. The method of claim 7 further including automatically monitoring the temperature of the heat transfer oil to maintain a predetermined temperature within the tank.

9. The method of claim 8 further including preheating the cold processing roofing material before pumping it into the heat exchange coil.

10. A spraying system for spraying cold processing roofing material and the like from a reservoir comprising:

an outer support housing;

a tank adapted to hold a fluidic heat transfer medium, the tank positioned in the support housing to provide a spaced passage along at least two sides and the bottom of the tank;

means for supplying heated gases directly to the tank along the spaced passage to heat the sides and bottom of the tank, and correspondingly, to heat the heat transfer medium;

a serrated finned heat transfer coil mounted within the tank;

a pump connected to the reservoir of cold processing roofing material and to one end of the serrated finned heat transfer coil; and spraying means connected to the other end of the heat transfer coil for distributing the cold processing roofing material to a surface to be coated, the fluidic heat transfer medium substantially surrounding the serrated finned heat transfer coil to effectuate a controlled, even heat transfer to the cold processing roofing material as it is pumped from the reservoir through the serrated finned heat transfer coil to the spraying means.

11. The invention of claim 10 further including mounting means for positioning the serrated finned heat transfer coil in the tank to permit unrestrained movement of the coil relative to the tank.

12. The invention of claim 10 wherein the heat transfer coil comprises a plurality of loops of tubing forming a serpentine configuration.

13. The invention of claim 10 further including automatic control means for controlling the temperature of the heat transfer medium in the tank.

14. The invention of claim 13 wherein the tank is only suspended from the upper walls of the outer housing within the outer housing.

15. The invention of claim 14 wherein the means for supplying heated gases includes a burner and source of fuel and the automatic control means includes, a heat sensor, a thermostat, a solenoid valve and a pressure regulator, the pressure regulator connected to the source of fuel and solenoid valve and maintaining a constant pressure of fuel upstream of the valve which in turn is connected to the burner, the heat sensor is connected to the thermostat and positioned in the heat transfer medium, the thermostat is connected to the solenoid valve for controlling the flow of fuel to the burner in response to a signal from the heat sensor.

16. The invention of claim 14 further including a safety pilot control means for preventing the flow of fuel to the burner if the burner is not lit.

17. The invention of claim 15 wherein the heat transfer coil further includes loops of tubing and spacer members for positioning the loops.

18. The invention of claim 16 wherein the spacer members are only welded to one set of loops to permit relative movement.

19. A portable spraying system for applying cold processing roofing material comprising the combination of:

a storage reservoir of a quantity of a bituminous based cold processing roofing fluid including a solid fiber additive;

an outer support housing;

a reservoir tank including a quantity of a fluidic heat transfer oil positioned in the support housing, the exterior of the tank spaced from the interior of the support housing to provide a spaced combustion chamber;

a combustion burner supported relative to the support housing to supply heated gases to the spaced combustion chamber to directly heat the reservoir tank, and correspondingly, the heat transfer oil;

a serrated finned heat transfer coil of at least two loops mounted within the tank;

means for supporting the heat transfer coil loops in the tank to permit a relative expansion movement of the loops;

a pump connected to the reservoir of cold processing roofing material and to one end of the serrated finned heat transfer coil; and spraying means connected to the other end of the heat transfer coil for distributing the cold processing roofing material to a surface to be coated, the fluidic heat transfer medium substantially surrounding the serrated finned heat transfer coil to effectuate a controlled, even heat transfer to the cold processing roofing material as it is pumped from the reservoir through the serrated finned heat transfer coil to the spraying means.

20. The invention of claim 19 further including automatic control means for controlling the temperature of the heat transfer medium in the tank.

21. The invention of claim 19 further including a low heat transfer material, such as asbestos, covering the interior of the support housing.

22. The invention of claim 20 further including a source of fuel for the combustion burner and the automatic control means includes, a heat sensor, a thermostat, a solenoid valve and a pressure regulator, the pressure regulator connected to the source of fuel and solenoid valve and maintaining a constant pressure of fuel upstream of the valve which in turn is connected to the burner, the heat sensor is connected to the thermostat and positioned in the heat transfer medium, the thermostat is connected to the solenoid valve for controlling the flow of fuel to the burner in response to a signal from the heat sensor to maintain the temperature of the heat transfer medium at a range providing a maximum temperature range of the cold processing roofing material not greater than 130°F.

23. The invention of claim 22 further including a safety pilot control means for preventing the flow of fuel to the burner if the burner is not lit.

* * * * *